US012735643B2

(12) United States Patent
Tharpe, Jr.

(10) Patent No.: US 12,735,643 B2
(45) Date of Patent: Sep. 15, 2026

(54) TOROIDAL PYROLYSIS CHAMBER ARRANGEMENT AND RELATED SYSTEMS AND METHODS

(71) Applicant: American Bio-Energy Converting Corp., Albany, GA (US)

(72) Inventor: Johnny Marion Tharpe, Jr., Albany, GA (US)

(73) Assignee: American Bio-Energy Converting Corp., Albany, GA (US)

( * ) Notice: Subject to any disclaimer, the term of this patent is extended or adjusted under 35 U.S.C. 154(b) by 229 days.

(21) Appl. No.: 18/591,038

(22) Filed: Feb. 29, 2024

(65) Prior Publication Data

US 2024/0301292 A1 Sep. 12, 2024

Related U.S. Application Data

(60) Provisional application No. 63/450,792, filed on Mar. 8, 2023.

(51) Int. Cl.
*C10B 47/44* (2006.01)

(52) U.S. Cl.
CPC ..... *C10B 47/44* (2013.01)

(58) Field of Classification Search
CPC ..... C10B 3/24; C10B 47/44; C10B 53/02
See application file for complete search history.

(56) References Cited

U.S. PATENT DOCUMENTS 3,335,461 A 8/1967 Schwartz
3,776,150 A * 12/1973 Evans ..... C10B 53/00 110/346
4,217,175 A * 8/1980 Reilly ..... C10B 53/00 414/217
4,308,103 A * 12/1981 Rotter ..... C10B 53/00 202/265
4,849,057 A 7/1989 Steinstrasser et al.
5,220,873 A * 6/1993 Milsap, III ..... C10B 7/10 110/240
7,931,783 B2 4/2011 Dam-Johansen et al.
8,206,471 B1 6/2012 Tharpe, Jr.
8,353,973 B2 * 1/2013 Tharpe, Jr. ..... C10C 5/00 48/197 FM
9,068,121 B1 6/2015 Tharpe, Jr.
9,447,325 B1 9/2016 Tharpe, Jr.
9,464,234 B1 * 10/2016 Tharpe, Jr. ..... C10B 49/08
(Continued)

FOREIGN PATENT DOCUMENTS

EP 3048161 A1 7/2016

*Primary Examiner* — Jonathan Miller

(74) *Attorney, Agent, or Firm* — ALLEN, DYER, DOPPELT + GILCHRIST, P.A.

(57) ABSTRACT

A pyrolysis chamber arrangement includes a pyrolysis chamber, a solid feed system and inner and outer heating elements. The pyrolysis chamber defines a toroidal passage extending along a chamber axis between inlet and outlet ends. The solid feed system includes an auger and ram assembly operable to supply particulate feedstock to the toroidal passage at the inlet end. The inner and outer heating elements extend outside inner and outer walls of the toroidal passage, respectively, and supply thermal input therethrough. An inner passage can be defined in the pyrolysis chamber, allowing gas or other pyrolysis to be accomplished simultaneously with the pyrolysis in the toroidal chamber.

11 Claims, 15 Drawing Sheets

(56) References Cited

U.S. PATENT DOCUMENTS

| | | | | |
|---|---|---|---|---|
| 9,605,210 | B2 * | 3/2017 | Tucker | C10B 53/00 |
| 9,663,733 | B2 * | 5/2017 | Hornung | C10B 7/10 |
| 9,719,020 | B1 | 8/2017 | Tharpe, Jr. | |
| 9,994,784 | B2 * | 6/2018 | Chataing | C10L 9/083 |
| 10,421,911 | B2 * | 9/2019 | Ullom | C10B 47/30 |
| 11,242,495 | B1 | 2/2022 | Tharpe, Jr. | |
| 11,542,435 | B2 * | 1/2023 | Neville | C10B 57/14 |
| 2004/0079262 | A1 * | 4/2004 | Hornung | F27B 7/18 110/229 |
| 2008/0006519 | A1 * | 1/2008 | Badger | C10B 49/20 48/127.3 |
| 2008/0006520 | A1 * | 1/2008 | Badger | C10B 51/00 202/202 |
| 2008/0128259 | A1 * | 6/2008 | Kostek | C10G 1/10 201/4 |
| 2008/0202983 | A1 * | 8/2008 | Smith | C10B 53/07 422/198 |
| 2009/0007484 | A1 * | 1/2009 | Smith | C10B 53/02 422/187 |
| 2009/0282738 | A1 * | 11/2009 | Tharpe, Jr. | C10B 49/20 48/203 |
| 2011/0067991 | A1 * | 3/2011 | Hornung | C10B 49/16 202/211 |
| 2016/0024390 | A1 * | 1/2016 | Ullom | C10G 1/086 202/99 |

* cited by examiner

TOROIDAL PYROLYSIS CHAMBER ARRANGEMENT AND RELATED SYSTEMS AND METHODS

PRIORITY APPLICATION

This application claims the benefit of U.S. Provisional Application No. 63/450,792, filed Mar. 8, 2023, the disclosure which is hereby incorporated by reference in its entirety.

FIELD OF THE INVENTION

The present invention relates to pyrolysis, and more particularly, to systems and methods for the pyrolysis of biomass.

BACKGROUND OF THE INVENTION

The need to both find alternative energy sources, particularly those which reduce excess carbon dioxide release, and decrease waste in various industrial and commercial processes is well recognized. One process that helps achieve all of these objectives is the pyrolysis of biomass. Biomass, or the fuel products derived from it, can be burned to produce power. Unlike fossil fuels, however, carbon dioxide released from the burning of biomass does not contribute to the overall carbon dioxide content of the atmosphere. This is true because biomass is part of the world's atmospheric carbon cycle. For this reason, biomass is viewed as a renewable, carbon-neutral fuel. As examples, processing facilities for forest products, used automotive tires and used railroad cross ties and municipal yard waste collection are substantial sources of biomass.

The fast pyrolysis of biomass utilizes high temperatures (typically in excess of 450 degrees Celsius) to rapidly heat biomass in the absence of oxygen. The end products of pyrolysis are pyrolysis oil (or bio-oil), char and non-condensing gases, all of which are combustible to some degree. While there are various ways to improve the overall efficiency of the pyrolysis process, one key element is improving the heat transfer to the particulate biomass feedstock.

SUMMARY OF THE INVENTION

In view of the foregoing, it is an object of the present invention to provide an improved pyrolysis chamber arrangement and related systems and methods. According to an embodiment of the present invention, a pyrolysis chamber arrangement includes a pyrolysis chamber, a solid feed system and inner and outer heating elements. The pyrolysis chamber defines a toroidal passage extending along a chamber axis between inlet and outlet ends. The solid feed system includes an auger and ram assembly operable to supply particulate feedstock to the toroidal passage at the inlet end. The inner and outer heating elements extend outside inner and outer walls of the toroidal passage, respectively, and supply thermal input therethrough.

The auger and ram assembly forms compacted feedstock toroids within the toroidal passage at the inlet end which are advanced through the toroidal passage by the formation of subsequent toroids. The toroids receive thermal input from both the inner and outer heating elements through the inner and outer walls of the toroidal passage, respectively.

According to an aspect of the present invention, active lengths of the inner and outer heating elements are varied to vary a thermal input profile along a length of the toroidal passage between the inlet and outlet ends.

According to another aspect of the present invention, the pyrolysis chamber further defines an inner passage extending along the chamber axis concentrically with the toroidal passage. The arrangement further includes a gas feed system operable to supply methane gas to the inner passage at the inlet end such that methane pyrolysis occurs in the inner passage simultaneously with the biomass pyrolysis in the toroidal chamber, resulting in mixing of hydrogen gas and the pyrolysis oil vapor at the outlet end.

These and other objects, aspects and advantages of the present invention will be better appreciated in view of the drawings and following detailed description of preferred embodiments.

DETAILED DESCRIPTION OF PREFERRED EMBODIMENTS

Figure 1:
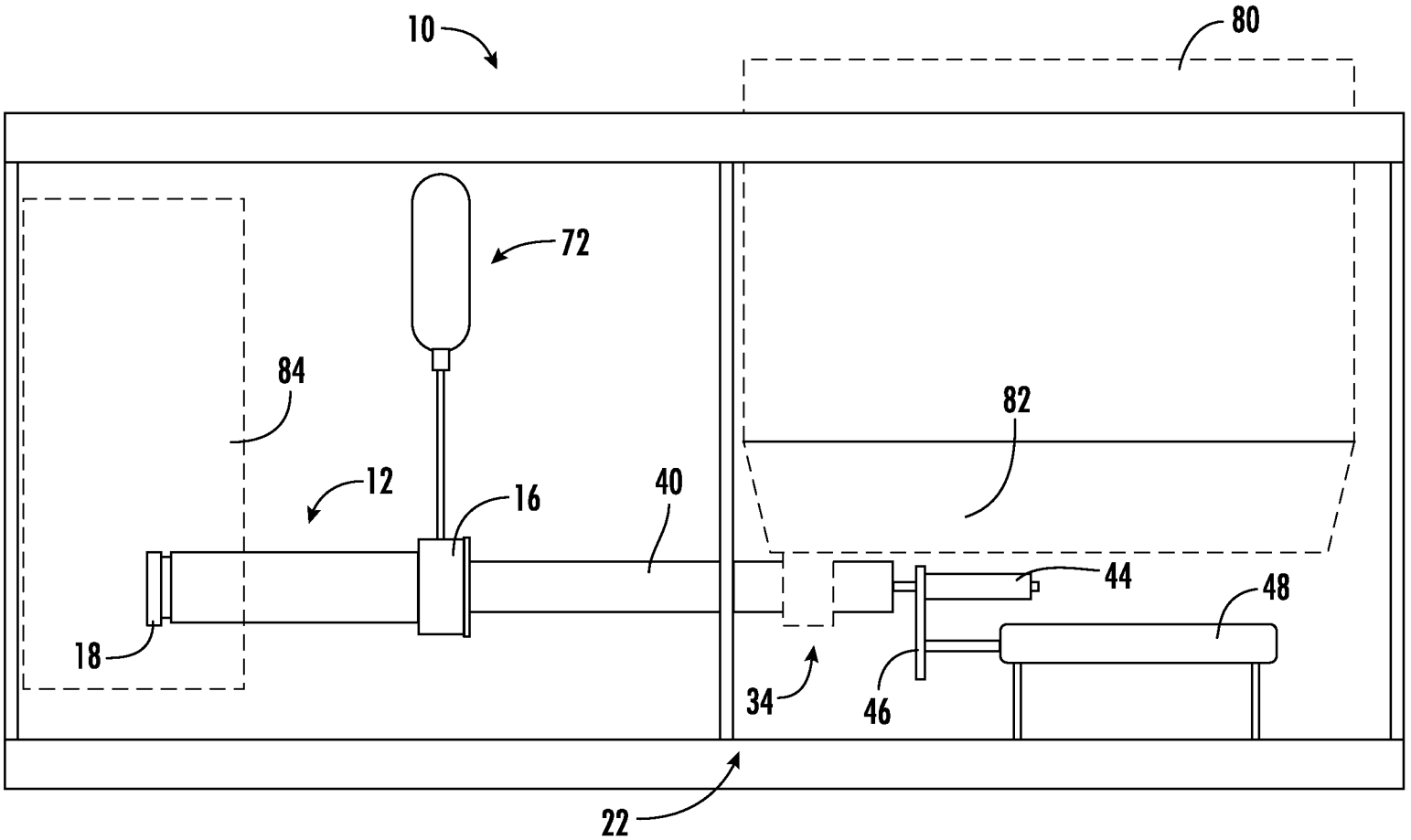
FIG. 1 is a schematic overview of a pyrolysis chamber arrangement including a pyrolysis chamber, a solid feed system, inner and outer heating elements and a gas feed system, according to an embodiment of the present invention.
Figure 2:
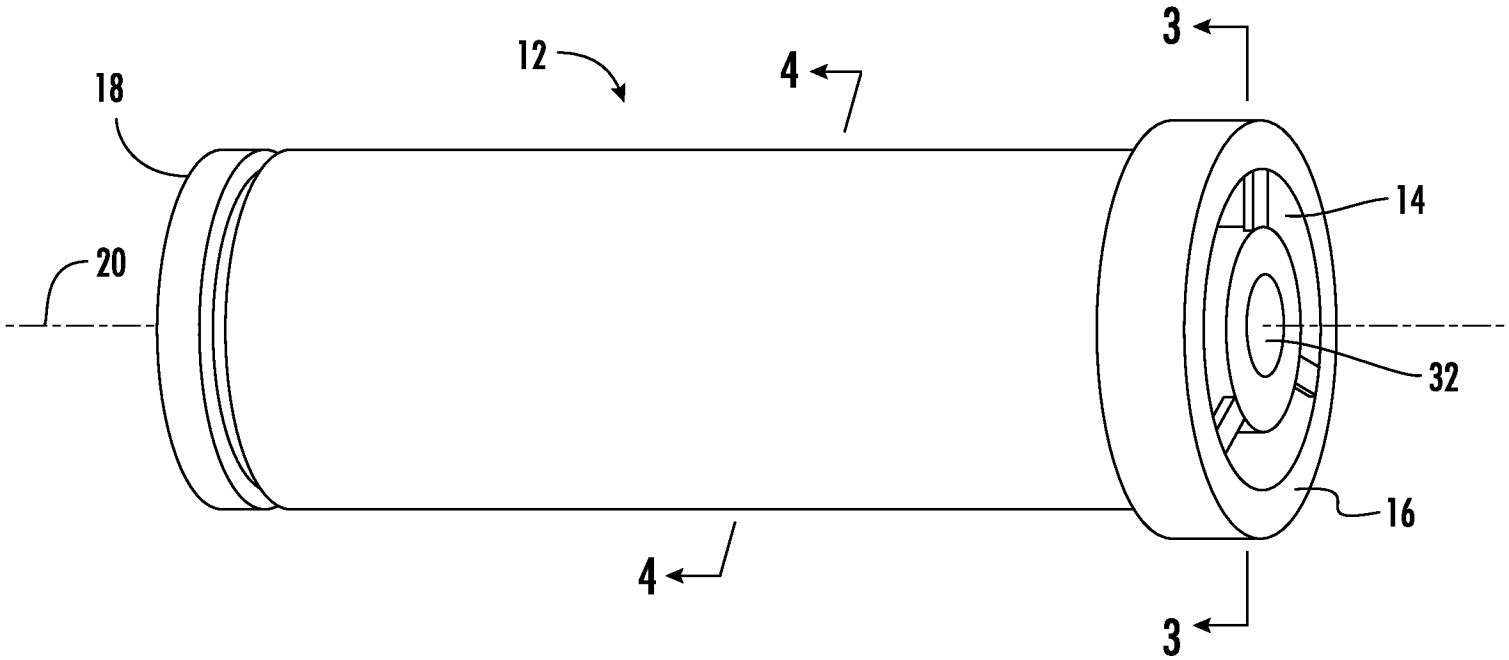
FIG. 2 is a perspective view of a pyrolysis chamber of the arrangement of FIG. 1.
Figure 3:
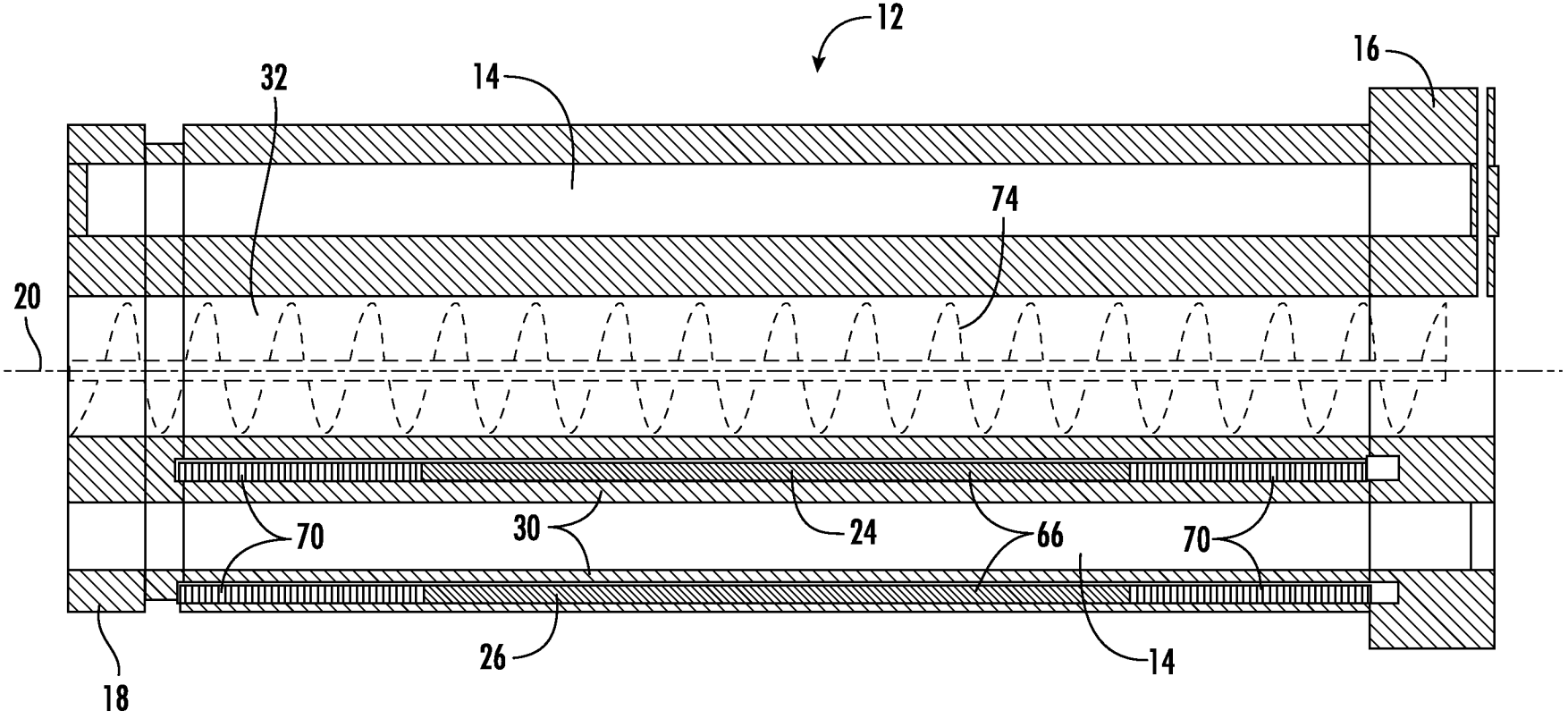
FIG. 3 is sectional view of the pyrolysis chamber taken along line 3-3 of FIG. 2.
Figure 4:
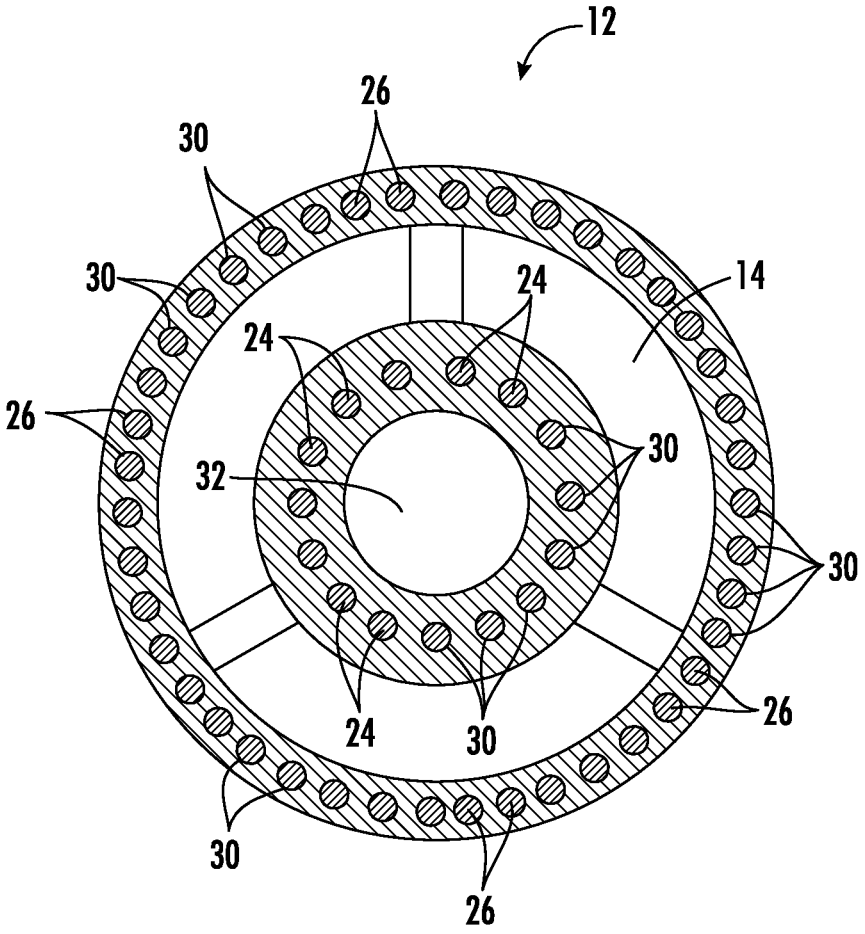
FIG. 4 is another sectional view of the pyrolysis chamber taken along line 4-4 of FIG. 2.

According to an embodiment of the present invention, referring to FIGS. 1-4, a pyrolysis chamber arrangement 10 includes a pyrolysis chamber 12 defining a toroidal passage 14 extending between chamber inlet and outlet ends 16, 18 along a chamber axis 20. A solid feed system 22 is connected at the inlet end 16 and is configured to drive particulate feedstock into and through the toroidal passage 14. Inner and outer heating elements 24, 26 extend between the inlet and outlet ends 16, 18 outside the inner and outer diameters of the toroidal passage 14, respectively. Particulate feedstock is compacted into toroids within, and driven through, the passage 14 by the solid feed system. The feedstock toroids are pyrolyzed by thermal input from the inner and outer heating elements 24, 26 as they move through the passage 14 toward the outlet end 18.

The pyrolysis chamber 12 can be formed of metal framing with ceramic or similar insulating elements. Advantageously, the pyrolysis chamber 12 can be formed as a unitary solid out of high temperature ceramic material within the toroidal passage 14 and heating element passages 30 formed integrally therein for closely accommodating the inner and outer heating elements 24, 26. In one preferred embodiment, the ceramic chamber is molded around the heating elements 24, 26, ensuring uniformly close engagement therewith.

It will be appreciated that the heating elements need not be embedded in passaged formed integrally into chamber walls. The heating elements could simply be mounted outside of inner and outer walls of the toroidal passage. Additionally, while the depicted toroidal passage is believed to represent a preferred embodiment, a "toroidal" passage as used herein does not necessarily require a passage that is concentric about the chamber axis, of uniform radial dimensions around the chamber axis, or circular. For the purposes of this application, a passage is "toroidal" if it has both internal and external walls from which heat can be supplied into the biomass passing therethrough.

Preferably, an inner passage 32 is also defined extending between the inlet and outlet ends 16, 18 surrounded by the inner heating elements 24 and generally concentric with the toroidal passage 14 about the chamber axis 20. The inner passage 32 can advantageously be used to perform methane pyrolysis simultaneously with the pyrolysis of the compacted feedstock toroids, as will be explained in greater detail below.

Figure 5:
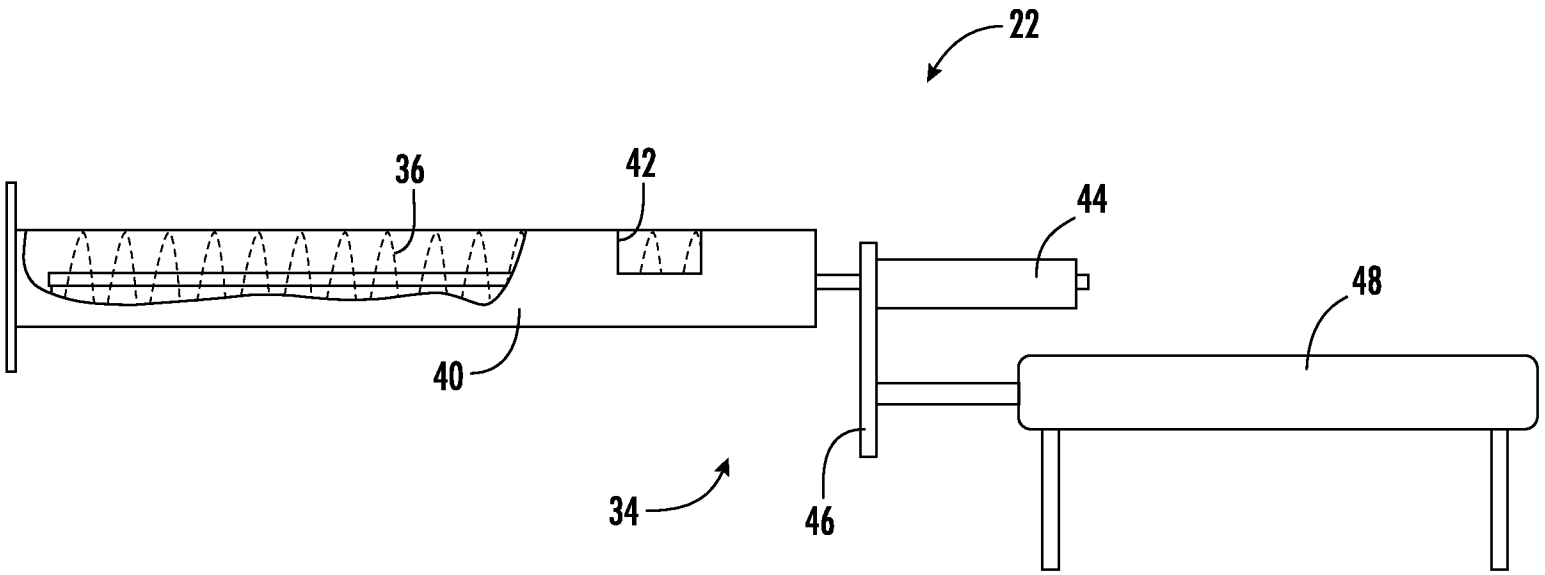
FIG. 5 is a partially cutaway side view of the solid feed system of the arrangement of FIG. 1.

Referring to FIG. 5, the solid feed system 22 includes a combination auger and ram assembly 34. The assembly 34 includes a screw-type auger 36 located within an auger housing 40 having an inlet 42 for receiving the particulate feedstock from a feed bin or the like. An auger motor 44 rotates the auger 36 about the chamber axis 20 to advance the feedstock to the inlet end 16 of the chamber 12 and into the toroidal passage 14. The auger 36 is mounted to an end plate 46 that is translatable along the chamber axis 20 via a ram drive 48.

Figure 6:
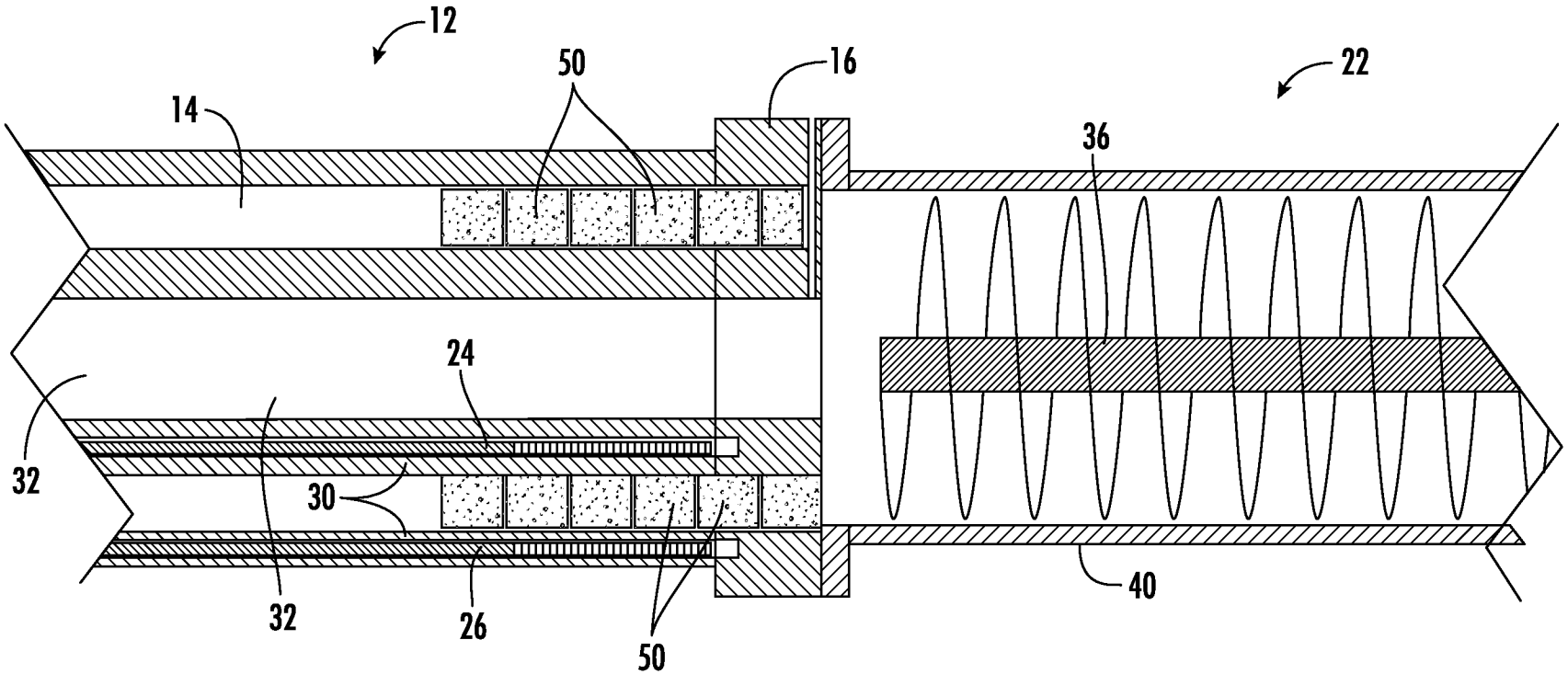
FIG. 6 is a sectional view of the pyrolysis chamber taken along line 3-3 of FIG. 2 also showing a portion of the solid feed system in the process of forming feedstock toroids.

Referring to FIG. 6, the linear action of the ram drive 48 functions to compact the particulate feedstock into a toroid 50 at the inlet end 16. As subsequent feedstock is fed and compacted behind previously formed toroid 50, the toroid 50 is advanced through the toroidal passage 14 along the chamber axis 20. Ultimately, a series of feedstock toroids 50 are advanced through the passage 14 in advancing states of pyrolysis as new toroids are formed therebehind.

The formation of these tightly compacted feedstock toroids 50 offers several significant advantages. For instance, because each toroid 50 is in contact with the inner and outer walls of the toroidal passage, each of which walls being in turn surrounded by respective heating elements 24, 26, conduction of heat into, and quick distribution of heat within, each toroid 50 is greatly enhanced. In addition to a general improvement in energy efficiency, a desired degree of pyrolysis can be achieved within a shorter chamber length than in conventional pyrolysis chambers-resulting in a reduced equipment footprint. Furthermore, the toroids effectively form a barrier preventing backflow of hot pyrolysis gases into the solid feed system 22.

Figure 6A:
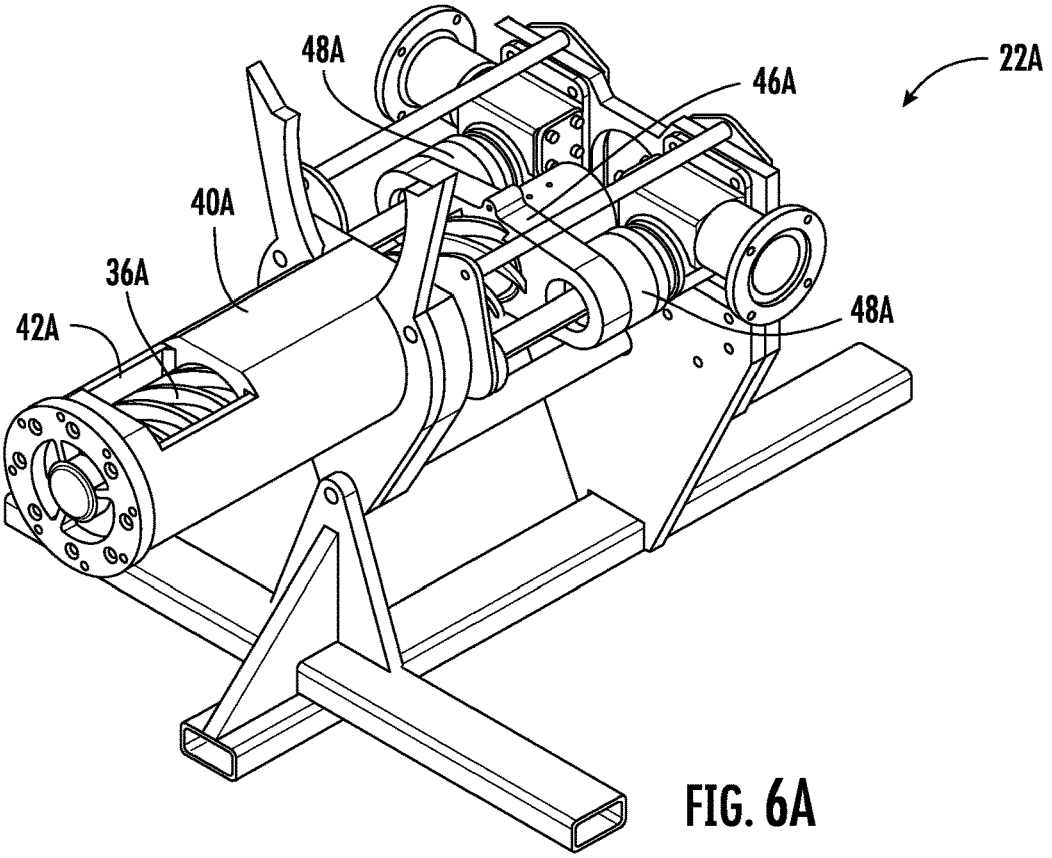
FIG. 6A is a perspective view of a solid feed system, according to another embodiment of the present invention.
Figure 6B:
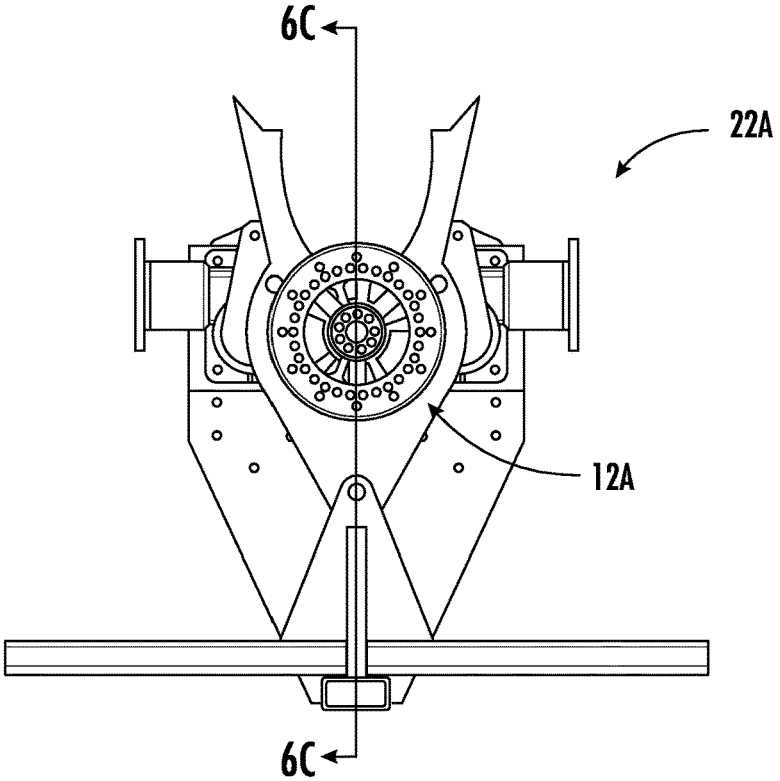
FIG. 6B is an end view of the solid feed system of FIG. 6A connected to a pyrolysis chamber.
Figure 6C:
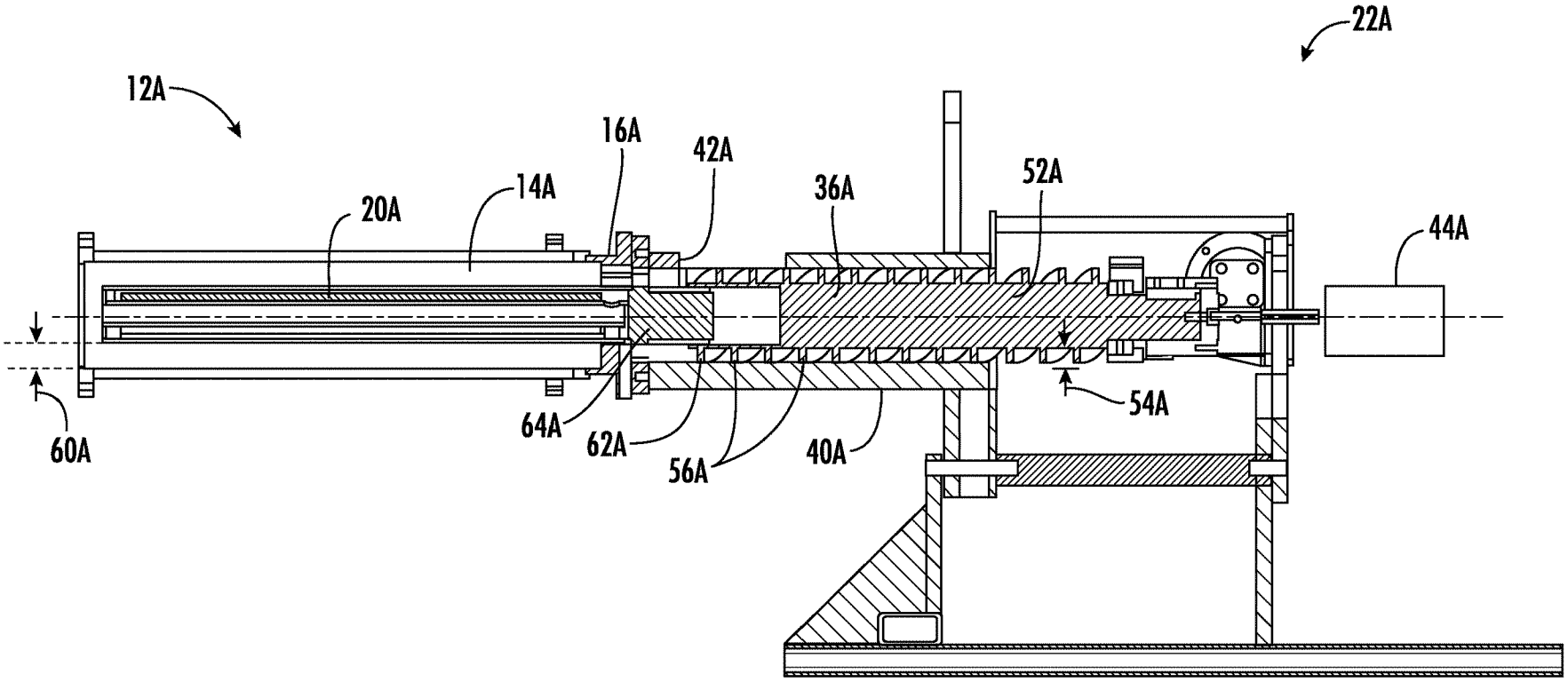
FIG. 6C is a sectional view taken along line 6C-6C of FIG. 6B.

Referring to FIGS. 6A-6C, according to an alternate embodiment of the solid feed system, a solid feed system 22A includes a modified screw-type auger 36A located within an auger housing 40A having an inlet 42A for receiving the particulate feedstock from a feed bin or the like. An auger motor 44A rotates the auger 36A about the chamber axis 20A to advance the feedstock to the inlet end 16A of the chamber 12A and into the toroidal passage 14A. The auger 36A is mounted to a drive plate 46A that is translatable along the chamber axis 20A via ram drives 48A.

A shaft 52A of the of the auger 36A has an increased diameter such that a radial dimension 54A of threads 56A of the auger 36A is slightly less than or equal to a radial dimension 60A of the toroidal passage 14A of the chamber 12A, facilitating transfer of the feedstock from the inlet 42A into the passage 14A at the inlet end 16A.

At a distal end 62A of the auger 36A adjacent the inlet end 16A of the chamber 12A, the shaft 52A of the auger 36A is hollow, allowing the distal end 62A to be rotatably supported by a hub 64A connected to the inlet end 16A while still allowing the translatable movement of the auger 36A along the chamber axis 20A. With the improved feedstock distribution afforded by the modified auger 36A, conditions for operation without use of the ram drive(s) 48A to form compacted feedstock toroids are more favorable.

The heating elements 24, 26 are preferably electrical resistance heating elements. The exterior periphery of the chamber 12 is preferably well insulated to minimize ambient heat loss from the outer heating elements 26, although the toroidal chamber 12 design tends to result in a significantly greater heat input into the toroidal passage 14 from each inner heating element 26. This allows fewer inner heating elements 24 to be used while still providing balanced heat input from both the inner and outer walls of the toroidal passage 14. For some applications, it may be desirable to adjust the thermal output of individual heating elements 24, 26 and/or the total number of heating elements used.

It can be advantageous that the heating elements 24, 26 do not provide thermal input adjacent to the inlet and outlet ends 16, 18. Thus, each element 24, 26 can (see FIG. 3) have a central active region 66 surrounded by terminal inactive regions 70. Generally, in one embodiment the central active region 66 is 26 inches and the terminal inactive regions 70 are each inches.

Figure 7A:
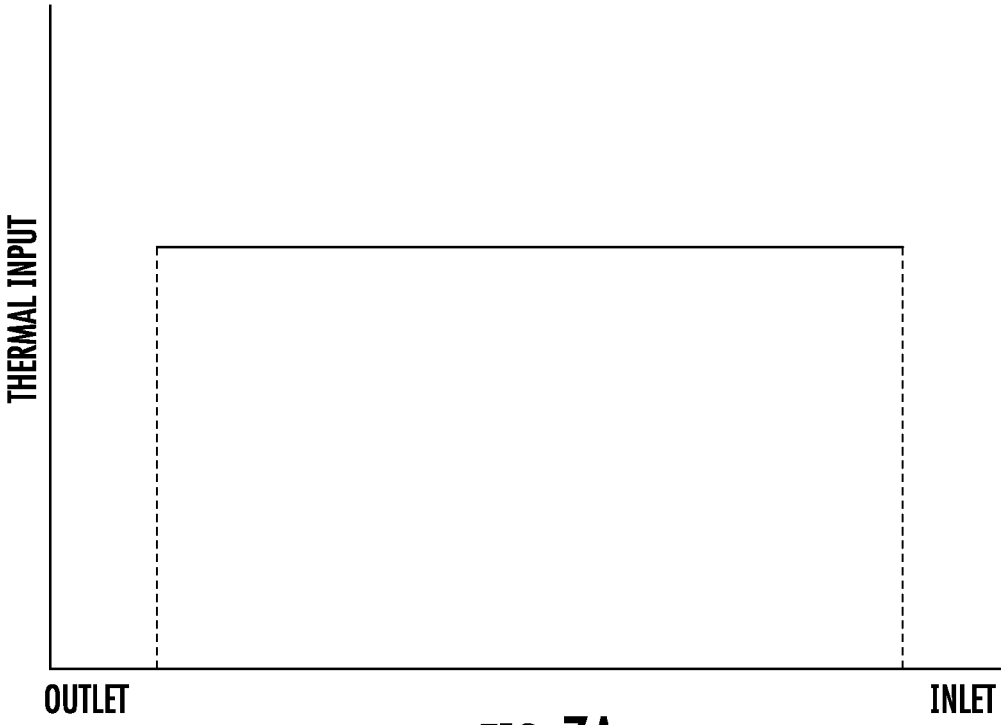
FIG. 7A is a thermal input profile along a chamber axis of the pyrolysis chamber of FIG. 2.
Figure 7B:
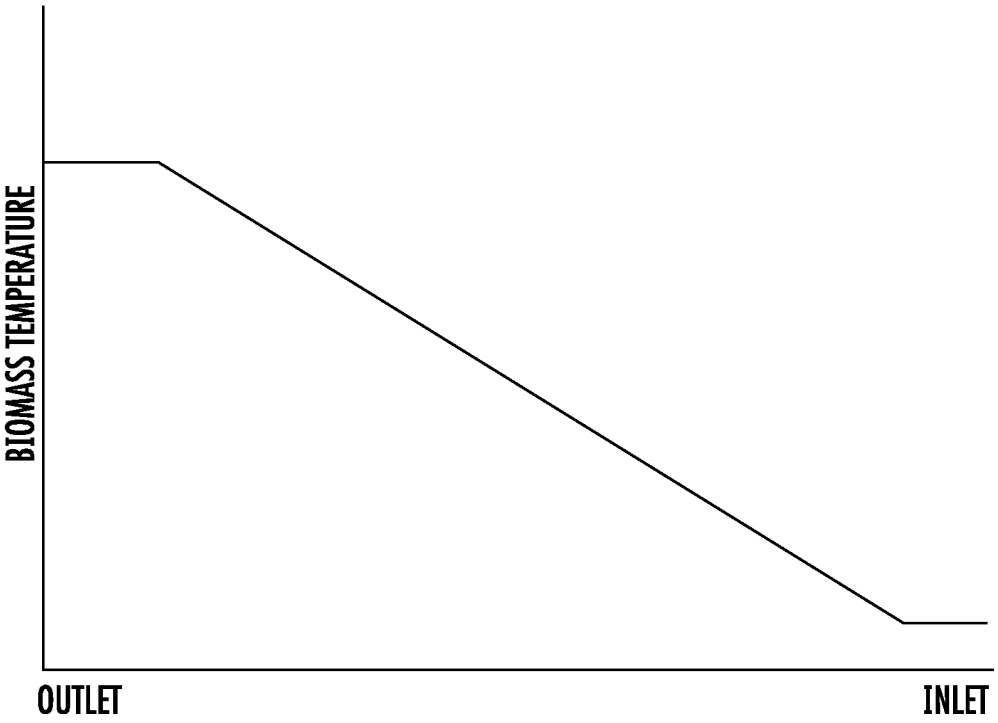
FIG. 7B is a temperature profile along the chamber axis of the pyrolysis chamber of FIG. 2.

In some embodiments, the active regions of all the heating elements 24, 26 are coextensive (as in FIGS. 3 and 4), resulting in a generally constant thermal input into the toroidal passage 14 along the length of the active regions and a generally linear increase in temperature of the feedstock toroids 50 (see FIGS. 7A and 7B).

Figure 8:
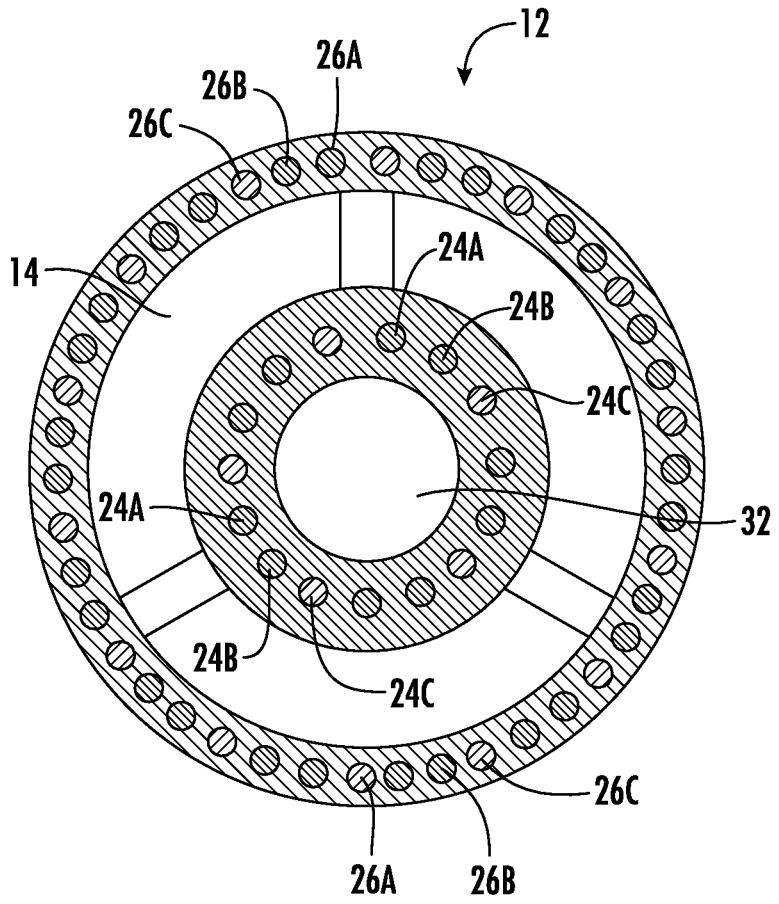
FIG. 8 is a sectional view of the pyrolysis chamber taken along line 4-4 of FIG. 2, according to an alternate embodiment of the present invention.
Figure 9A:
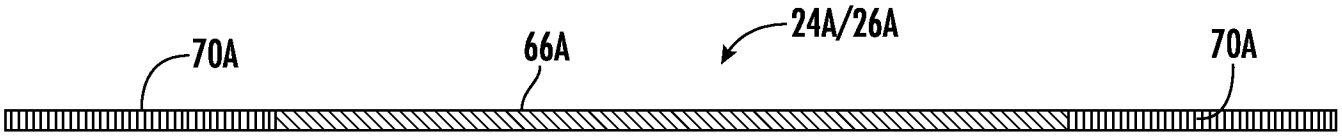
FIGS. 9A-C are side views of exemplary heating elements of the pyrolysis chamber of FIG. 8.
Figure 9B:
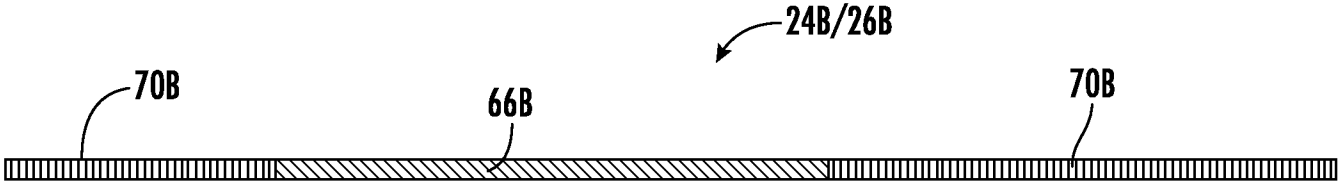
Figure 9C:
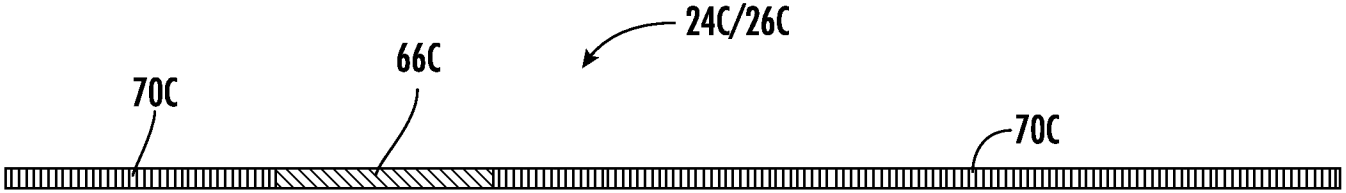

In other embodiments, the lengths of the active regions can be varied (see FIG. 8), resulting in a variable thermal input. In the FIG. 8 embodiment, only a first portion of the heating elements 24A, 26A have a longest active region 66A (see FIG. 9A), while a second portion 24B, 26B have an active region 66B that is approximately ⅔ the length of the active region 66A (see FIG. 9B), and a third portion 24C, 26C have an active region 66C approximately ⅓ the length of the active region 66A (see FIG. 9C). The heating elements 24A/B/C, 26A/B/C are arranged such that their respective active regions 66A/B/C all terminate at that same point proximate the outlet end 20, such that thermal input is only provided by the heating elements 24A initially, then by both the heating elements 24A/B, and finally be all the heating elements 24A/B/C.

Figure 10A:
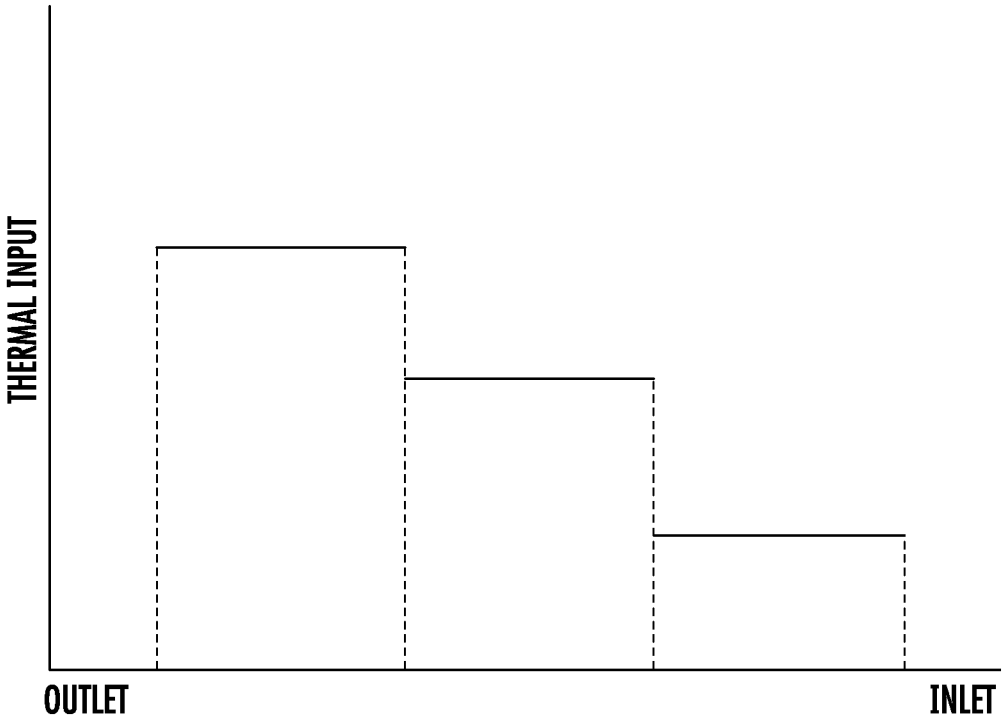
FIG. 10A is a thermal input profile along a chamber axis of the pyrolysis chamber of FIG. 8.
Figure 10B:
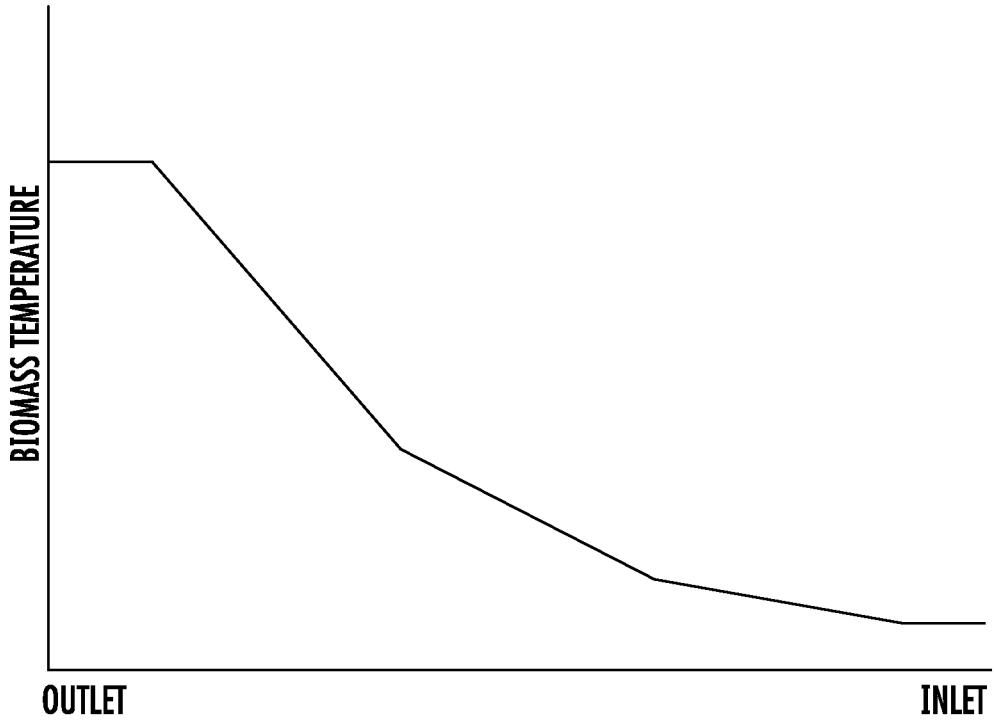
FIG. 10B is a temperature profile along the chamber axis of the pyrolysis chamber of FIG. 8.

This configuration of active regions 66A/B/C results in increases in thermal input along the length of the toroidal passage 14 and correspondingly incrementally ramped increases in temperature of the feedstock toroids (see FIGS. 10A and 10B). This thermal profile has been found advantageous for the formation of graphitic carbon suitable for graphene production in the solid material remaining in each toroid 50 after pyrolysis.

As mentioned above, the inner passage 32 can advantageously be used to perform methane pyrolysis simultaneously with the pyrolysis of the compacted feedstock toroids 50. For this purpose, referring again to FIG. 1, the chamber arrangement 10 can further include a gas feed system 72 operable to supply a controllable flow of gas, such as methane ($CH_4$), to the inner passage 32 (see FIGS. 2 and 3). The thermal input into the inner passage 32, primarily from the inner heating elements 24, will pyrolyze the methane into solid carbon (C) and hydrogen gas ($H_2$). The gas feed system 72 can be equipped with an inner auger 74 for clearing any carbon deposition from the inner passage 32. The gas feed system 72 could be used to supply other gases to the inner passage, including nitrogen or other inert gas.

As previously disclosed by this applicant (see U.S. Pat. No. 11,242,495, issued Feb. 8, 2022), pyrolysis oil can be made stably miscible with petroleum feedstock-derived oil without conventional upgrading or the addition of additional chemicals such as emulsifiers. In general terms, this is accomplished by mixing the pyrolysis vapor with the oil vapor and condensing the mixed vapors together. As the vapor formed by the biomass pyrolysis in the toroidal passage 14 and the $H_2$ gas generated by the methane pyrolysis in the inner passage 32 will mix together after leaving the outlet end 18 of the chamber, an equivalent miscible pyrolysis oil composition can be readily formed without any separate apparatus for vaporization of a petroleum feedstock-derived oil.

Figure 11:
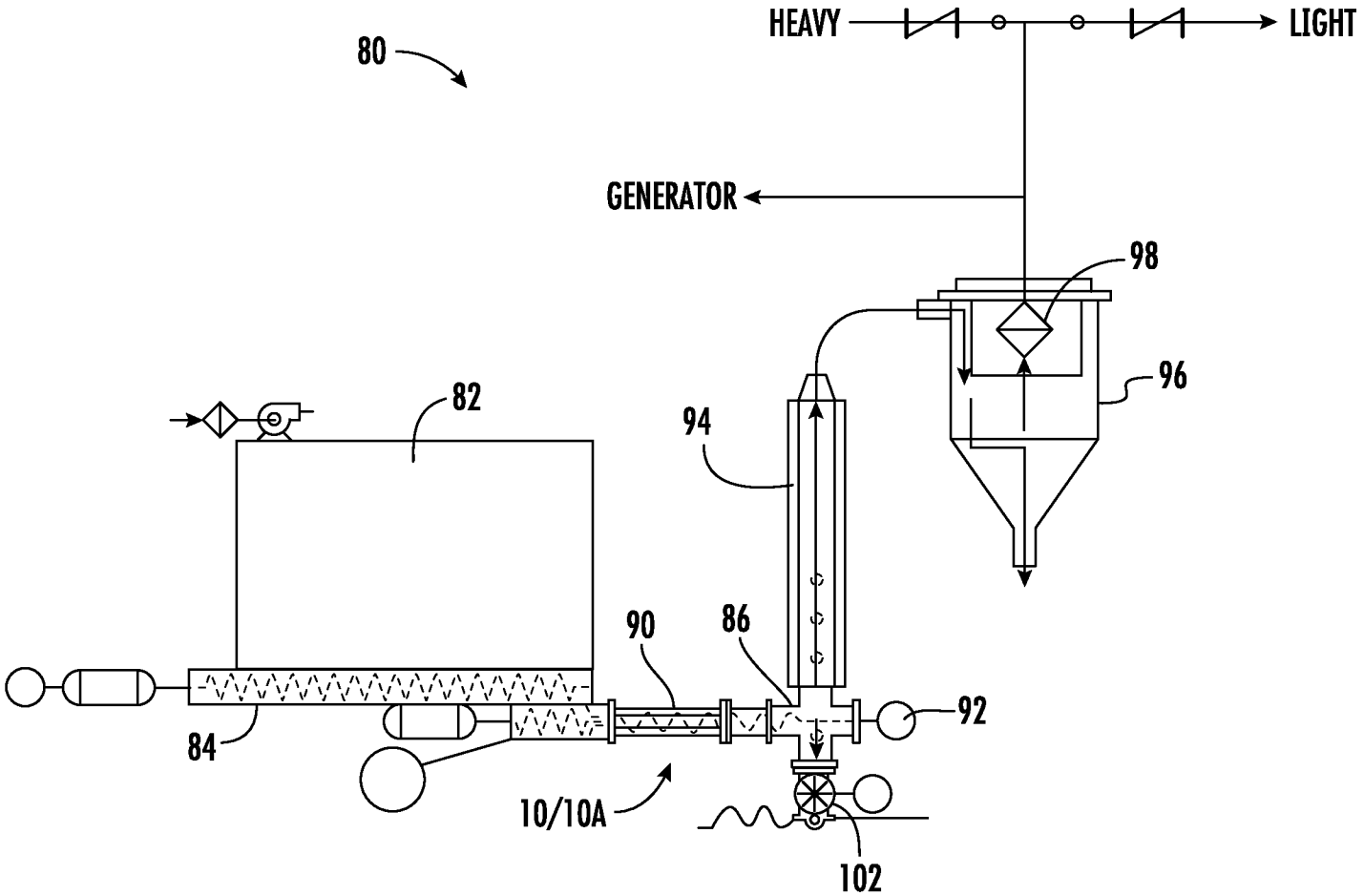
FIG. 11 is a schematic view of a pyrolysis system including the pyrolysis chamber arrangement of FIG. 1.

A pyrolysis chamber arrangement 10 (or 10A) according to the present invention can be readily integrated into a complete pyrolysis system 80. Referring to FIG. 11, particulate biomass is fed to the chamber arrangement 10/10A from a biomass bin 82 via a pre-feed auger 84. Carbon solids, pyrolysis vapor and non-condensable gases (NCGs) are all output from the pyrolysis chamber arrangement 10/10A into an output chamber 86. A toroidal auger 90, driven by a motor 92, advantageously extends into the toroidal passage 14/14A from the output chamber 86 and facilitates the removal of the carbon solids therefrom.

The pyrolysis vapor and NCGs travel through an insulated riser section 94 and pass through a carbon/gas separator 96 to remove any carbon that may remain entrained therewith, with the pyrolysis vapor and NCGs subsequently passing through a hot gas filter 98. The filtered pyrolysis vapor and NCGs can be used directly for power generation, or subjected to further processing, as will be described in greater detail below. Generally, subsequent processing of the pyrolysis vapor and NCGs will vary depending on whether the desired final product is light or heavy pyrolysis oil. As used herein, "light" pyrolysis oil has a lower density than water while "heavy" pyrolysis oil has a higher density than water.

Figure 12:
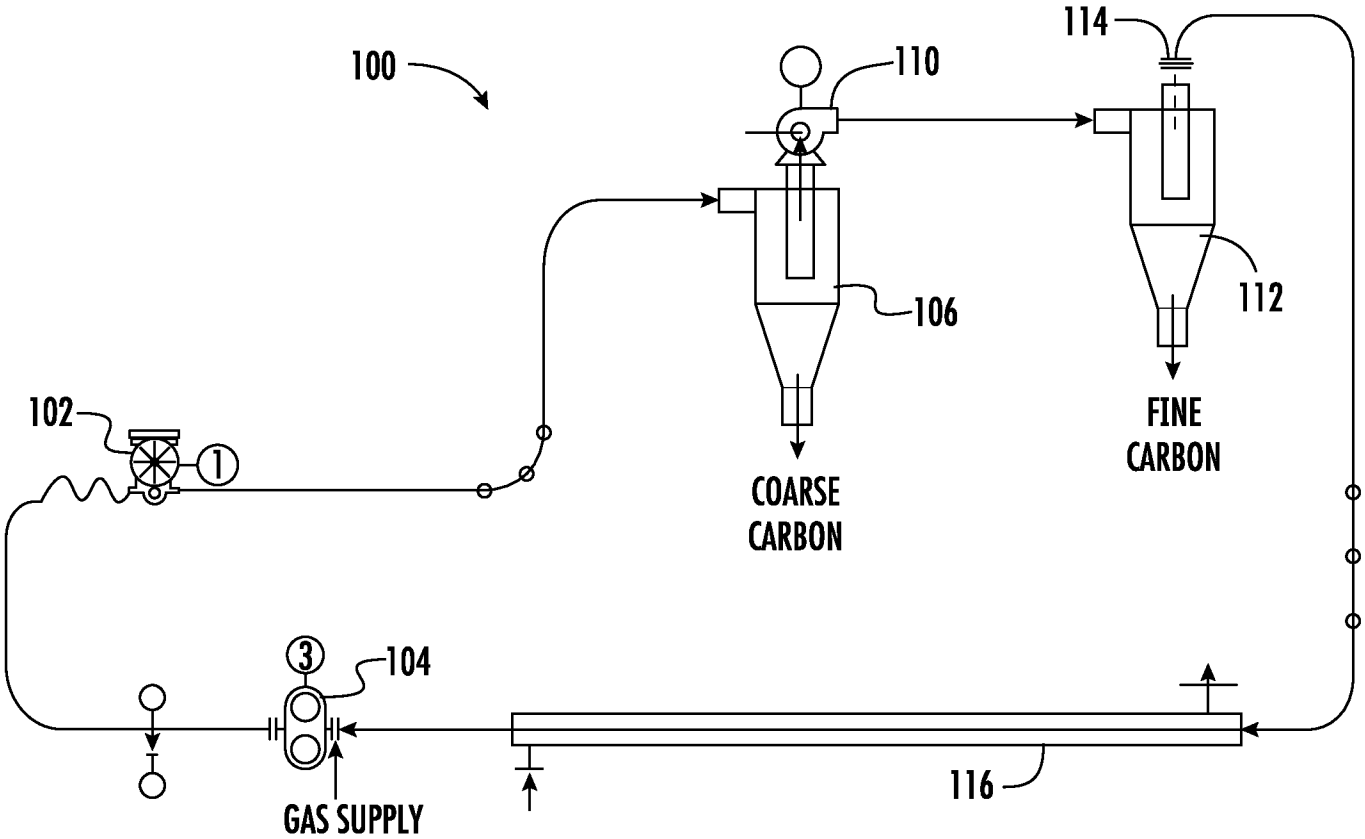
FIG. 12 is a schematic view of a carbon entrainment loop of the pyrolysis system of FIG. 11.

Non-entrained carbon in the output chamber 86 falls via gravity and is removed and introduced into a carbon entrainment loop 100 (see FIG. 12) by a blow-through rotary air valve 102. An entrainment blower 104 forces an inert entrainment gas (such as nitrogen) to entrain the carbon from the valve 102, which is then introduced into a first carbon cyclone 106, from which coarser carbon is removed. Remaining fine carbon in the entrainment gas is introduced via entrainment fan 110 into a second carbon cyclone 112, from which fine carbon is removed. An output filter 114 removes remaining solids from the entrainment gas, which is then passed through an entrainment gas cooler 116 before recirculating back through the loop 100.

Figure 13:
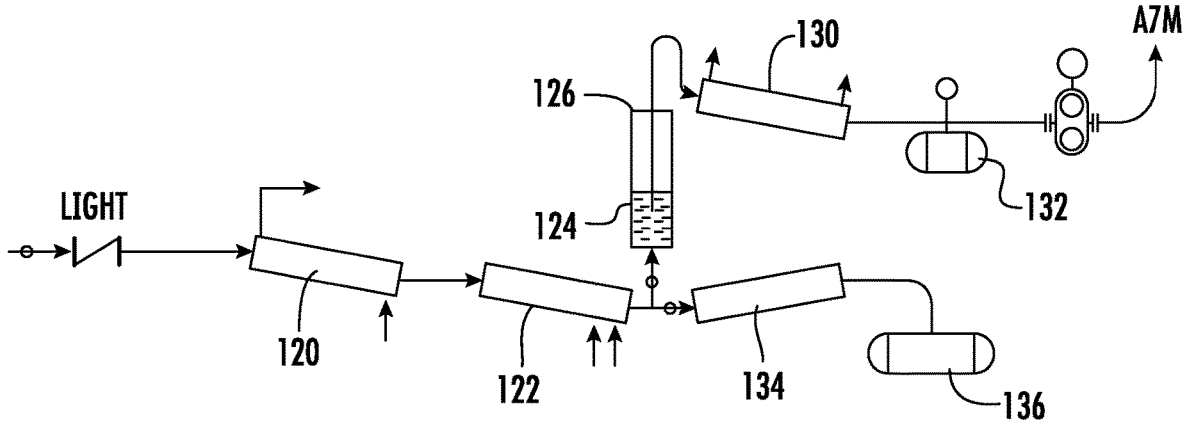
FIG. 13 is a schematic view of light pyrolysis oil processing equipment of the pyrolysis system of FIG. 11.

Referring to FIG. 13, for the processing of light pyrolysis oil, the vapor and NCGs are passed through a pyrolysis vapor cooler 120 before the pyrolysis vapors are condensed in a condenser 122. After the condenser, the NCGs are removed through a demister 124 and gas separator 126. Brine created by the separation is passed through a brine cooler 130. The NCGs are vented off and the brine is stored in a brine tank 132. The condensed pyrolysis vapor is then routed through a second cooler 134 before being stored in a tank 136.

Figure 14:
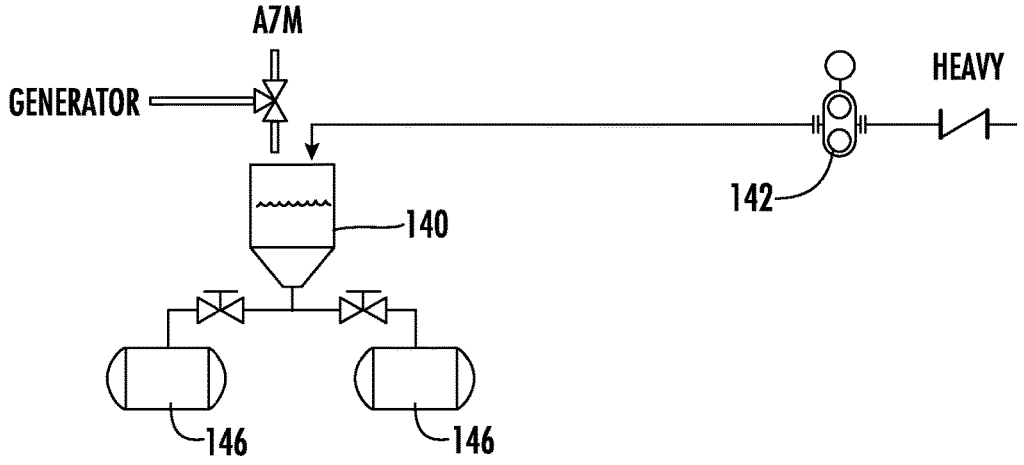
FIG. 14 is a schematic view of heavy pyrolysis oil processing equipment of the pyrolysis system of FIG. 11.

Referring to FIG. 14, for the processing of heavy pyrolysis oil, the pyrolysis vapor and NCGs are forced into a quench tank 140 by a blower 142. The heavy pyrolysis oil sinks to the bottom of the quench tank 144, from whence it is collected in one or more storage tanks 146. The NCGs are either vented or burned to produce energy.

The above-described embodiments are provided for illustrative purposes; the present invention is not necessarily limited thereto. Rather, those skilled in the art will appreciate that various modifications, as well as adaptations to particular circumstances, will fall within the scope of the invention herein shown and described and of the claims appended hereto.

The invention claimed is:

1. A pyrolysis system comprising:

a pyrolysis chamber having a chamber inlet end and chamber outlet end, said pyrolysis chamber comprising, an outer pyrolysis chamber having inner and outer chamber walls formed generally concentric to each other defining an outer passage as a toroidal passage extending between the chamber inlet end and chamber outlet end along a chamber axis, an inner pyrolysis chamber having an inner passage radially inward of the inner chamber wall and extending between the chamber inlet and outlet ends along the chamber axis, a plurality of outer heating elements arranged at the outer chamber wall, a plurality of inner heating elements arranged at the inner chamber wall, and an inner auger arranged within the inner passage and operable to remove deposits therefrom, and wherein the inner pyrolysis chamber, inner heating elements, outer pyrolysis chamber and outer heating elements are generally concentric; and a solid feed system including:

an auger located within an auger housing having distal end connected to the chamber inlet end and having a housing inlet for receiving particulate feedstock; and an auger motor operable to rotate the auger to advance the particulate feedstock from the housing inlet to the chamber inlet end and into the toroidal passage;

a ram drive operable to translate the auger back and forth within the auger housing along a longitudinal axis defined by the chamber, wherein a radial dimension of teeth of the auger is less than or equal to a radial dimension of the toroidal passage; and wherein each of the plurality of heating elements has an active region and of equal length, and different portions of the active regions of the plurality of heating elements have different lengths, the active regions of each of the different portions of heating elements each terminating an equal distance from the chamber outlet end.

2. The system of claim 1, wherein the plurality of heating elements are arranged around inner and outer chamber walls of the pyrolysis chamber and located radially inward and outward of the toroidal passage, respectively.

3. The system of claim 2, wherein more of the plurality of heating elements are located radially outward of the toroidal passage than radially inward.

4. The system of claim 3, wherein the pyrolysis chamber is formed as a unitary solid.

5. The system of claim 4, wherein the pyrolysis chamber is formed of a ceramic material.

6. The system of claim 2, wherein an inner passage is defined within the inner wall extending between the chamber inlet and outlet ends along the chamber axis.

7. The system of claim 6, wherein the inner passage is concentric with the toroidal passage.

8. The system of claim 7, further comprising a gas feed system operable to supply a controllable flow of gas to the inner passage.

9. The system of claim 1, further comprising a toroidal auger arranged in the toroidal passage and operable to advance pyrolyzing feedstock therethrough.

10. The system of claim 1, wherein the plurality of heating elements are electrical resistance heating elements.

11. The system of claim 1, wherein each of the plurality of heating elements has a pair of inactive regions arranged on opposite ends of the active region.

* * * * *